United States Patent [19]

Yang

[11] Patent Number: 4,790,156

[45] Date of Patent: Dec. 13, 1988

[54] BAGGAGE ZIPPER LOCKING DEVICE

[76] Inventor: Fu-Hsiung Yang, No. 158-1, 3rd Floor, Chao-Chou St., Taipei, Taiwan

[21] Appl. No.: 90,327

[22] Filed: Aug. 28, 1987

[51] Int. Cl.[4] ..... E05B 67/38

[52] U.S. Cl. ..... 70/68; 70/74; 24/386; 24/387

[58] Field of Search ..... 70/68–76; 24/386, 387

[56] References Cited

U.S. PATENT DOCUMENTS

| | | | |
|---|---|---|---|
| 3,319,743 | 5/1967 | Pelavin et al. | 70/68 X |
| 3,965,706 | 6/1976 | Davis | 70/68 |
| 3,971,458 | 7/1976 | Koenig | 70/68 X |
| 4,081,882 | 4/1978 | Toepelt et al. | 70/68 X |
| 4,112,990 | 9/1978 | Anderson | 70/68 X |
| 4,213,314 | 7/1980 | Trader | 70/68 |
| 4,366,684 | 1/1983 | Bako et al. | 70/68 |
| 4,514,884 | 5/1985 | Kaneko | 70/68 X |
| 4,514,915 | 5/1985 | Galetta | 70/68 X |
| 4,578,966 | 4/1986 | Kasai | 70/68 |
| 4,691,540 | 9/1987 | Murase | 70/68 |

*Primary Examiner*—Gary L. Smith
*Assistant Examiner*—Suzanne L. Dino
*Attorney, Agent, or Firm*—Leonard Bloom

[57] ABSTRACT

A baggage zipper locking device and particularly to a sealing and locking device through a zipper for the baggage container such as a baggage case and a baggage pack, which is characterized in that, one zipper leaf at one end of the zipper is provided with a raised locking hook, and another zipper leaf at the other end thereof is provided with a hooking gap for freely passing through by the said locking hook, and a lock with a hasp is provided to the bottom of the baggage container, so that after the said baggage container is fastened with the zipper, the said locking hook passes through the said hooking gap to be locked tightly onto the said hasp so as to complete the locking of said baggage container.

1 Claim, 4 Drawing Sheets

BAGGAGE ZIPPER LOCKING DEVICE

BACKGROUND OF THE INVENTION

The present invention relates to a baggage locking device and particularly to a baggage zipper locking device.

The conventional baggage locking device, as shown in FIG. 7, which is a combination view, wherein two locks are provided to the opening side of the baggage, a locking leaf is provided to each of the left and right sides of the baggage cover, each locking leaf is provided with a raised locking hook, a seat of lock is provided to the upper end of the baggage container base near the opening, and each seat of lock is provided with a hasp which tightly locks each corresponding locking hook so as to complete the locking of the baggage container.

However, the conventional baggage locking device has many drawbacks. For instance, the baggage cover and the baggage base often fail to entirely and closely seal each other, so the baggage locking is poor; and in the course of carrying or handling the baggage, the foreign impact force, which takes place accidentally and concentrates wholly onto the lock at once, will damage the lock or lead to a incomplete locking of baggage container since the locking hook and hasp have never been capable of withstanding such an undue foreign impact force.

SUMMARY OF THE INVENTION

In accordance with the teachings of the present invention, there is disclosed herein an improvement for a baggage container of the type having at least two edges adapted to be joined by a separable zipper fastener; this zipper has a pair of opposite ends and a pair of slider elements which meet to close. Each of the slider elements has a respective zipper leaf secured thereto. The baggage container is further of the type having a baggage zipper locking device for securing the zipper leafs to one another. This holds the fastener in a closed position, sealing and locking the luggage container. The improvement on this structure, in combination, includes one zipper leaf which has a first end that is secured to a respective slider that is positioned at one end of the zipper. This one zipper leaf further has a second opposite free end provided with a raised locking hook that has a substantially U-shaped configuration. Another, second zipper leaf is provided having a first end which is secured to a respective slider that is positioned at the other opposite end of the zipper. This second zipper leaf further has a second opposite free end provided with a hooking gap formed therein for removably receiving the locking hook when the one zipper leaf is placed at least partially overlapping the second zipper leaf. Finally, a lock with a hasp is secured to the baggage container. In this fashion, after the baggage container is closed with the slider elements of the zipper, the one zipper leaf is placed at least partially overlapping the second zipper leaf. The locking hook is carried on the second free end of the one zipper leaf and is received through the hooking gap which is formed in the second free end of the second zipper leaf engaging the hasp, whereby the hasp removably secures the locking hook. In this fashion, the one and the second zipper leafs of the the baggage container are locked in place.

Figure 1:
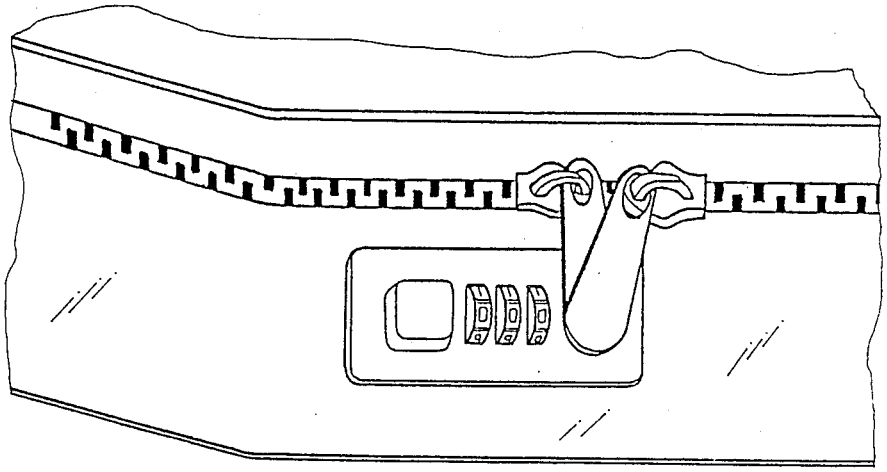
FIG. 1 is a combination view of the baggage zipper locking device of the present invention.
Figure 7:
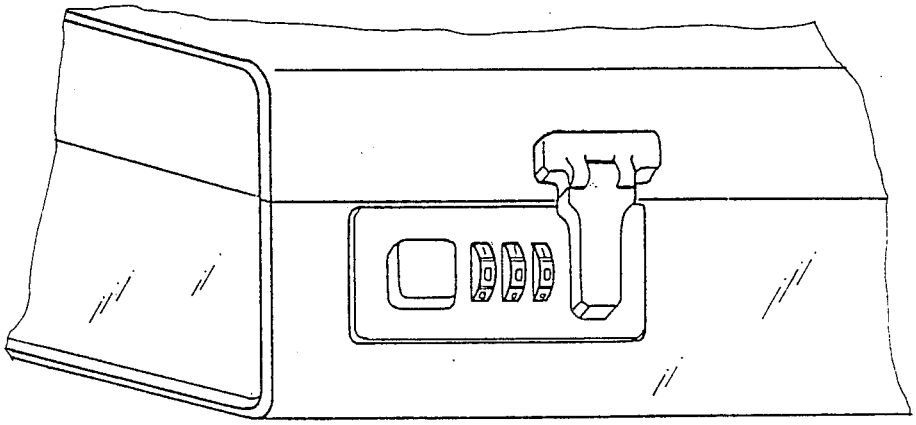
FIG. 7 is a combination view of conventional baggage locking device.

Wherein the cross reference numbers indicate the following:

1, 1B . . . zipper leaf
3 . . . lock seat
5, 5A . . . hooking gap
2, 2B . . . zipper leaf
4 . . . locking hook
6 . . . lock hasp

DETAILED DESCRIPTION OF THE PREFERRED EMBODIMENT

The present invention is designed to improve and eliminate the foregoing drawbacks of the conventional baggage locking device.

Figure 2:
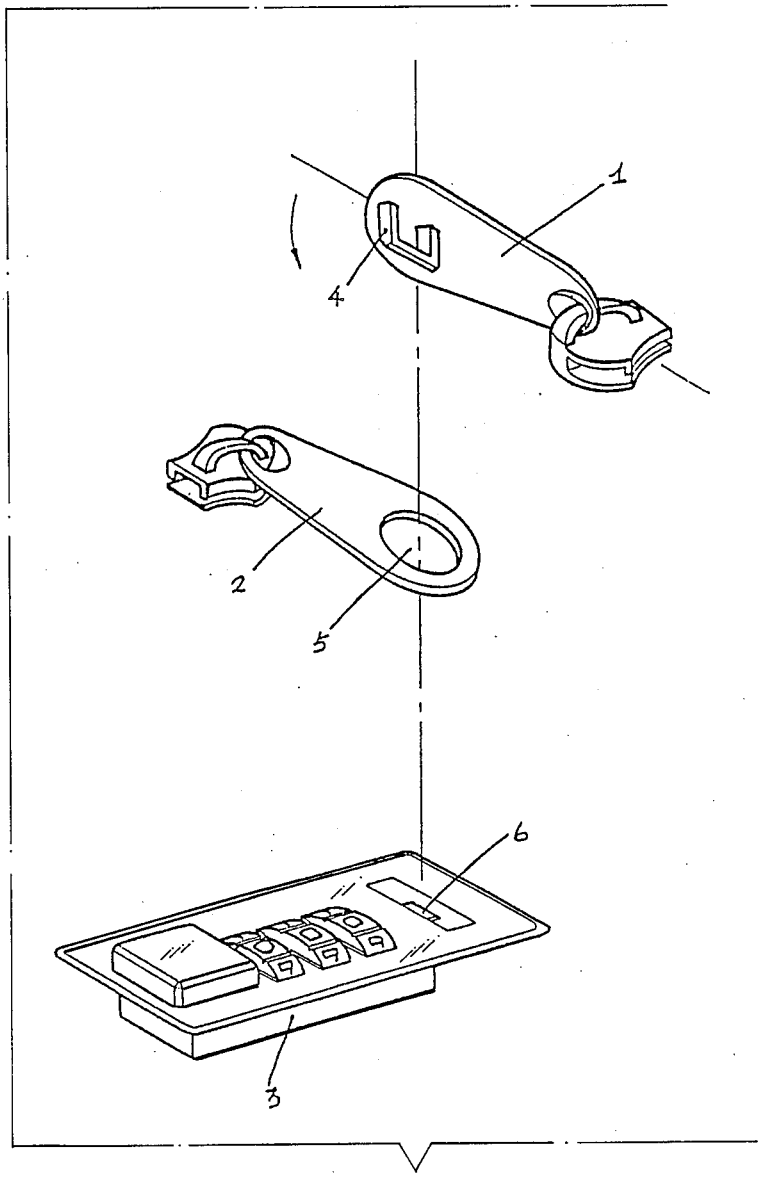
FIG. 2 is a structural view of the baggage zipper locking device of the present invention.

As shown in FIG. 1, a combination view of the baggage zipper locking device of the present invention, and FIG. 2, a structural view of the baggage zipper locking device of the present invention, wherein the baggage zipper locking device of the present invention can seal the opening of the baggage container through the zipper, a zipper leaf 1 at one end of the zipper is provided with a raised locking hood 4, a hooking gap 5 is provided to another zipper leaf 2 at the other end thereof for freely passing through by the said raised locking hook 4, and a lock seat 3 with a lock hasp 6 is provided to the upper end of the baggage container base near the opening so that after the zipper seals the baggage container, the said raised locking hook 4 passes through the said hooking gag 5 in order to be tightly locked by the said lock hasp 6 and to complete the locking of the baggage.

According to the baggage locking device of the present invention, the lock tends to lock tightly because the baggage container is sealed through the zipper, and the lock and baggage locking will never be damaged by the foreign impact force which will accidentally take place in the course of carrying or handling the baggage and be evenly absorbed as a whole by the zipper so that the locking hook and lock hasp will never be needed to withstand such an undue foreign impact force.

Figure 3:
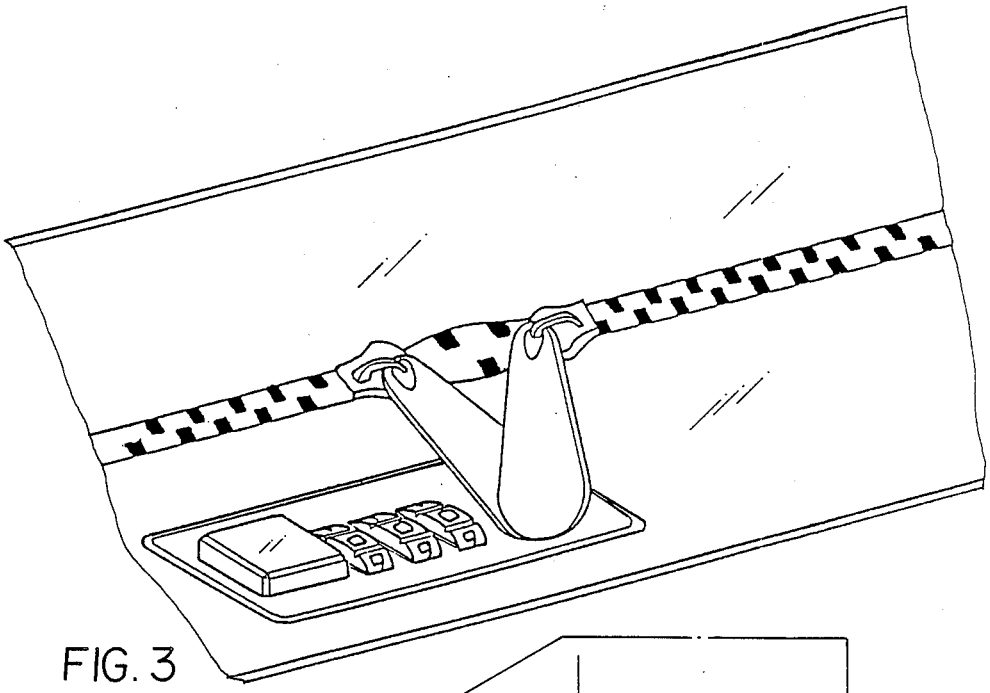
FIG. 3 is an assembly view of one example of the baggage zipper locking device of the present invention.
Figure 4:
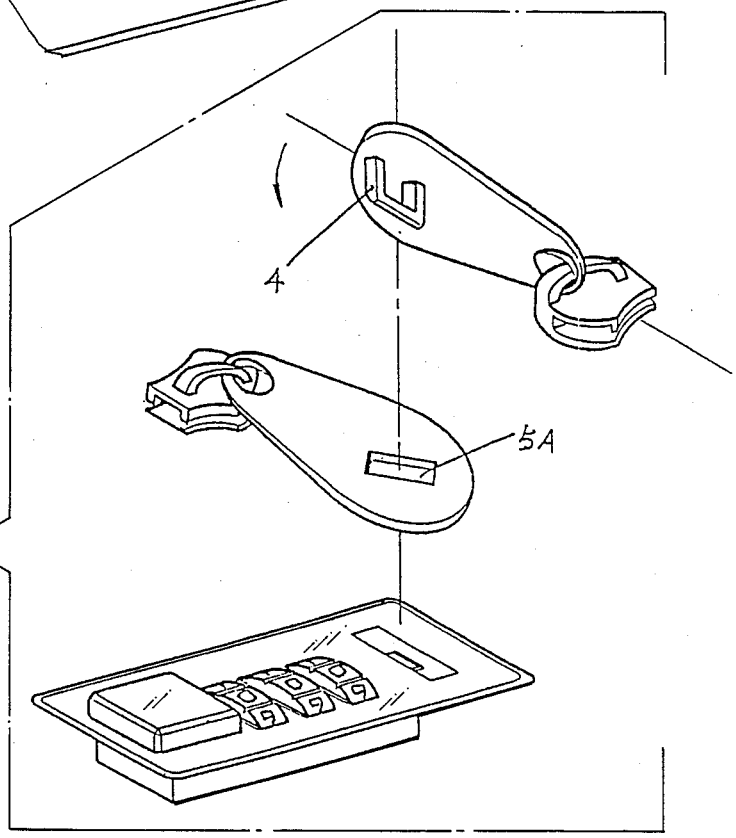
FIG. 4 is a structural view of one example of the baggage zipper locking device of the present invention.

FIG. 3 is an assembly view of one example of the present invention and FIG. 4 is a structural view of one example of the present invention, wherein the hooking gap 5A and locking hook 4 are rectangular.

Figure 5:
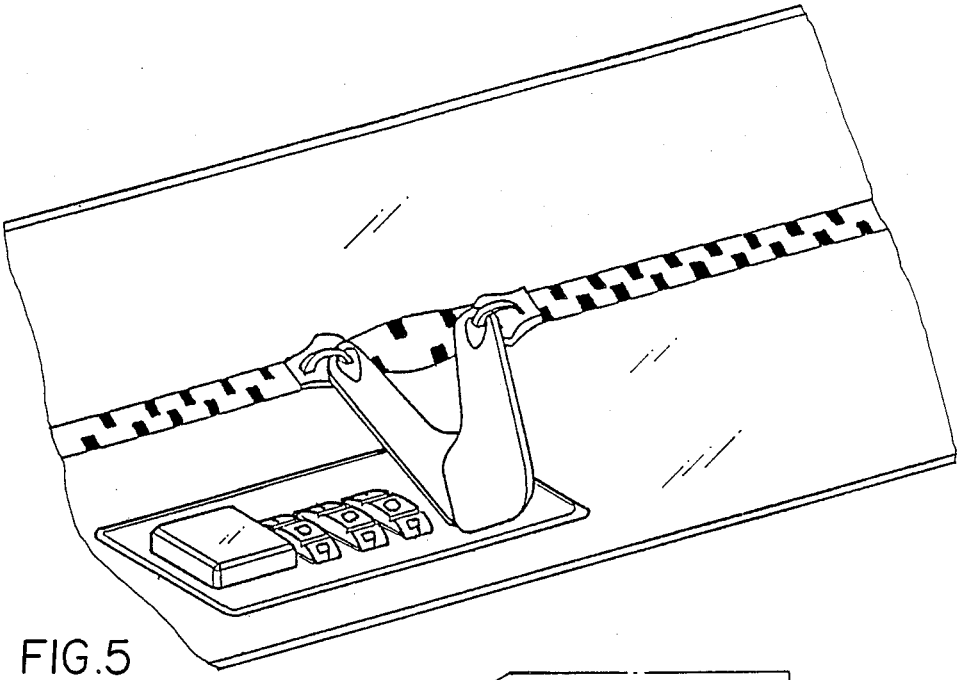
FIG. 5 is an assembly view of another example of the baggage zipper locking device of the present invention.
Figure 6:
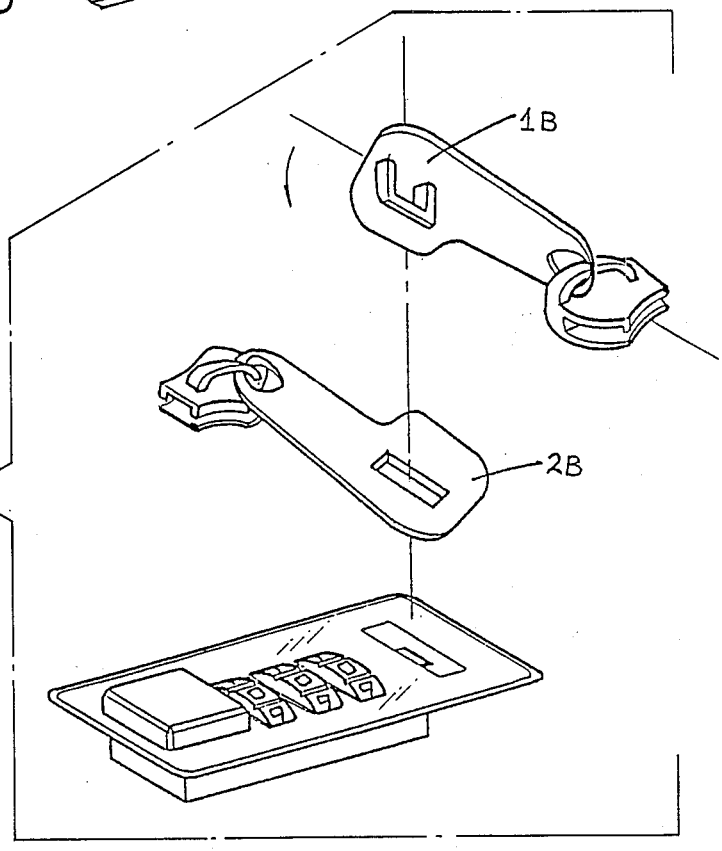
FIG. 6 is a structural view of another example of the baggage zipper locking device of the present invention.

FIG. 5 is an assembly view of another example of the present invention and FIG. 6 is a structural view of another example of the present invention, wherein the tails of zipper leaves 1B and 2B are changed into square form instead of the round ones of zipper leaves 1 and 2.

Therefore, the shapes of zipper leaves, locking hooks and hooking gaps of the baggage zipper locking device of the present invention can be changed infinitely.

I claim:

1. In a baggage container of the type having at least two edges adapted to be joined by a separate zipper fastener having a pair of opposite ends and a pair of slider elements which meet to close, each of which slider elements has a respective zipper leaf secured thereto, the baggage container further being of the type having a baggage zipper locking device for securing the zipper leafs to one another, so as to hold the fastener in a closed position, sealing and locking the luggage container, the improvement thereupon, in combination, comprising:

one zipper leaf having a first end secured to a respective slider positioned at one end of the zipper, said one zipper leaf further having a second opposite free end provided with a raised locking hook having a substantially U-shaped configuration, another second zipper leaf having a first end secured to a respective slider positioned at the other opposite end of the zipper, said second zipper leaf further having a second opposite free end provided with a hooking gap formed therein for removably receiving the said locking hook when the one zipper leaf is placed at least partially overlapping the second zipper leaf; and a lock with a hasp secured to the baggage container, so that after the said baggage container is closed with the slider elements of the zipper, the one zipper leaf is placed at least partially overlapping the second zipper leaf, and the said locking hook carried on the second free end of the one zipper leaf is received through said hooking gap formed in the second free end of the second zipper leaf and engages the hasp, whereby the hasp removably secures the locking hook, so as to lock the one and the second zipper leafs of the said baggage container in place.

* * * * *